United States Patent [19]

D'Agnolo et al.

[11] 4,357,792

[45] Nov. 9, 1982

[54] DEFLECTOR FOR SPINDLES IN DOUBLE TWISTING MACHINES

[75] Inventors: Armando D'Agnolo, Porcia; Luigi Colli; Ugo Gaiotti, both of Pordenone, all of Italy

[73] Assignee: Officine Savio S.p.A., Pordenone, Italy

[21] Appl. No.: 190,637

[22] Filed: Sep. 24, 1980

[30] Foreign Application Priority Data

Sep. 24, 1979 [IT] Italy ..... 60457/79[U]

[51] Int. Cl.[3] ..... D01H 7/86; D01H 15/00

[52] U.S. Cl. ..... 57/279; 57/58.83

[58] Field of Search ..... 57/58.83–58.86, 57/279, 280, 58.7

[56] References Cited

U.S. PATENT DOCUMENTS

| | | | |
|---|---|---|---|
| 2,597,015 | 5/1952 | May | 57/58.83 |
| 2,625,786 | 1/1953 | Klein | 57/58.83 X |
| 3,494,119 | 2/1970 | Ratti | 57/58.83 X |
| 3,731,478 | 5/1973 | Franzen | 57/58.83 X |
| 4,117,655 | 10/1978 | Smith | 57/58.83 |
| 4,168,605 | 9/1979 | D'Agnolo | 57/58.83 X |

FOREIGN PATENT DOCUMENTS

| | | | |
|---|---|---|---|
| 602419 | 9/1934 | Fed. Rep. of Germany . | |
| 1472459 | 1/1967 | France | 57/58.83 |
| 2162079 | 7/1973 | France . | |
| 2324556 | 4/1977 | France . | |
| 989235 | 4/1965 | United Kingdom . | |

*Primary Examiner*—John Petrakes

*Attorney, Agent, or Firm*—Stevens, Davis, Miller & Mosher

[57] ABSTRACT

A deflector for twisting double twisting spindles with pneumatic threading of the filament and with prepositioning of the rotating part of the spindle during the threading phase. Substantially between the circumference described by the wall containing the outlet port of the filament of the rotating part and the peripheral rim of the rotating plate is arranged at least temporarily an angular deflector in cooperation with the neighborhood of the radial plane in which is disposed the outlet of the filament in the rotating part cooperating through its extension with the neighborhood of the tangent to the curved rim of the rotating plate.

11 Claims, 7 Drawing Figures

DEFLECTOR FOR SPINDLES IN DOUBLE TWISTING MACHINES

Figure 1:
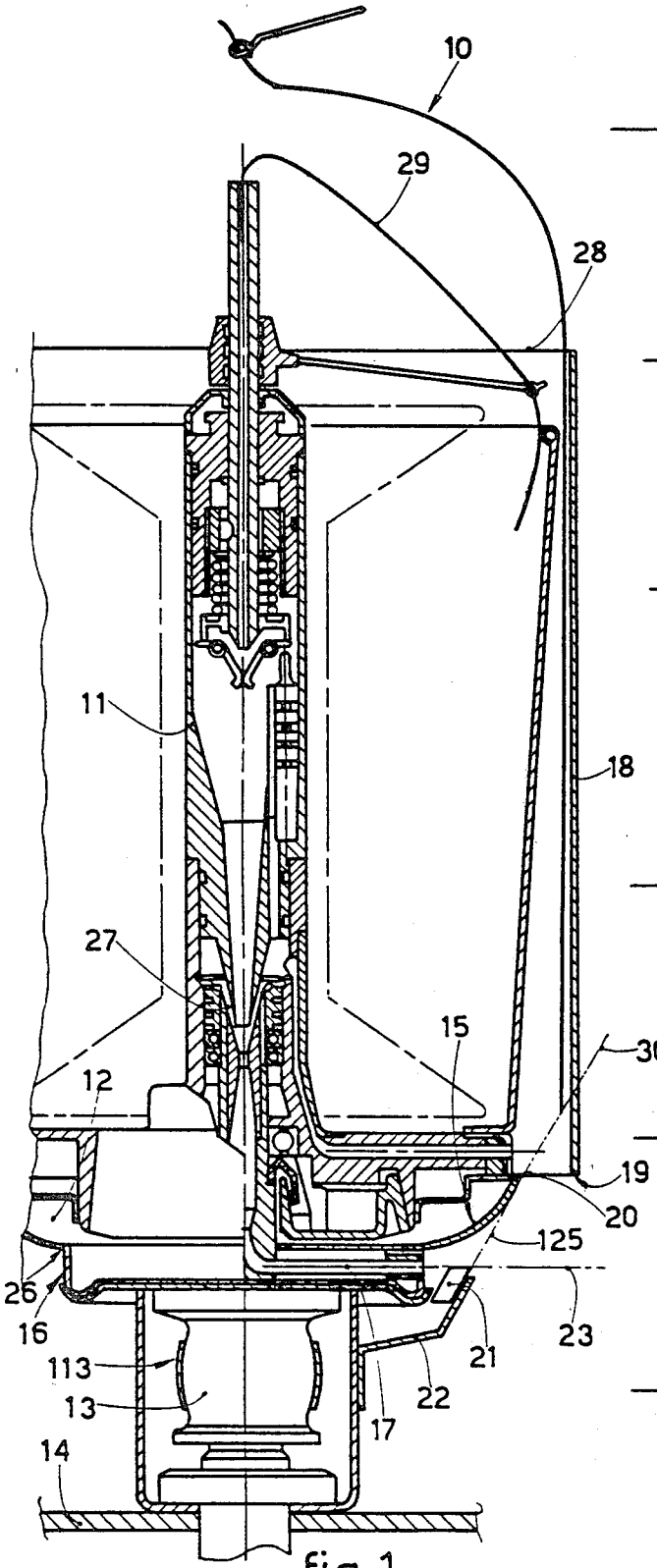
Figure 2:
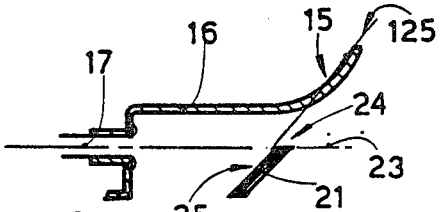
Figure 3:
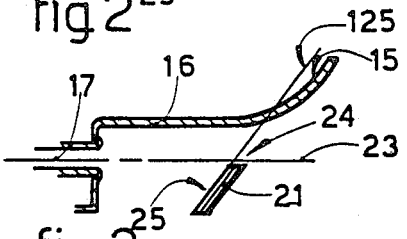

The present invention relates to a deflector for spindles in double twisting machines.

More specifically the present invention relates to a deflector for spindles in double twisting machine which is intended for deflecting the filament emerging from the substantially radial conduit provided in the rotating part of the double twisting spindle.

It is known that in double twisting spindles, in the area adiacent to the rotor, and particularly in the circumferential neighborhood cooperating with the substantially radial conduit from which emerges the filament during the double twisting phase, a great quantity of dirt is formed and deposited.

This area is normally provided by an external plate which deflects the filament mainly during the threading phase.

It is particularly on this plate and in its vicinity that the dirt deposits.

Such dirt adversely affects both the efficiency of the machine due the need for frequent cleaning and the products quality whereby the filament comes into contact with such dirt and eventually carries some of the dirt with it.

In addition, where double twisting spindles are provided with a filament lubricating device, the lubricating liquid mixes with such dirt and forms therewith a harmful sludge.

This inconvenience is strongly felt since it requires frequent cleaning and creates the risk that the filament is dirtied and/or deteriorated by coming in contact with, and dragging sludge with it.

To obviate such inconveniences a deflector has been discovered which offers numerous advantages.

By starting from the assumption that the fixed plate which covers the rotating part of the spindle or rather the vertical downward extension of the balloon external container, serves prevalenty, even if not essentially, during the filament threading phase, the applicant has studied and experimented with diverse solutions suitable for eliminating this at least according to the normal stucturing used hitherto.

It was noticed that in double twisting spindles with pneaumatic filament threading, the filament, during the threading phase, after being first launched in the radial direction bends upward following the flux of the fluid deflected by the external plate.

During the normal working cycle, the rotational speed of the spindle's rotating part results in the formation of a substantially radial fluid flux which can provoke some disturbances but without properly cleaning the external plate.

In the DE PS No. 602.419, the form of bowl "q" is so proposed that the defects that the present invention attempts to eliminate are greatly put in evidence.

The presence of the turned up edge "q" also causes problems of threading, dirt spotting and collection and so on which are not acceptable in modern double twisting spindles.

The solution proposed by GB No. 989.235 is basically different from that the present invention and retains all defects the present invention solves.

The bowl 31 of FR No. 2.162.079, which serves only in the threading stage, has such a form that can not achieve the tasks of the present invention.

A deflector of a limited height, placed at an angle, positioned in the neighborhood of the filament exit port in the rotating part, serves to overcome the foregoing disadvantages.

The scope is reached both during the threading phase and during the working phase in certain specific cases wherein the balloon requires a support at the lower part thereof.

In the threading phase the deflector executes its functions by the cooperation of the gaseous fluid emerging from the port dragging therewith the filament and the behavior of the filament itself, all being in cooperation with the deflector and that portion of the plate making part of the rotating portion of the spindle.

Such a deflector, can have different inclinations as a function of the rotational speed of the spindle dimensions of the same, as a function of the pressure of the gaseous fluid used for threading the filament, as a function of the curve of the plate's edge present in the rotating part of the spindle, and so on.

It was found, however, that such deflector can have a substantially minimal height in comparison to the rest of the spindle and even in comparison to the rotating part.

It was also found that in double twisting spindles with pneumatic threading and with prepositioning of the spindle's rotating part, such deflector can be substantially limited to the neighborhood of the spindle's rotating part.

According to the invention, such a deflector may be limited to a small circumferential section by can extend further to circumferentially enclose all of the neighborhood of the spindle's rotating part and that is both in relation to the spindle positioning and the auxiliary functions that are to be executed by the deflector or in relation to the position of the deflector in the normal work phase of the spindle.

From the tests made, it was proved that a further improvement to the performance can by obtained whereby the outlet port, provided in the rotating part, is kept as near as possible to the plate's curved edge provided at a higher point with respect to said port and in the rotating part.

It was also found from the tests that the deflector can be provided, in relation to the curved part of the plate present in the spindle's rotating part, in such a position that the extension of the deflector towards the plate is in the neighborhood of the tangent to the plate at the point of encounter.

Thus the deflector's extension could be steeper than, parallel to, or less inclined than the tangent itself as a function of the fluid pressure, the filament type, and the position of the deflector with respect to the plate of the filament's outlet port.

According to the tests done, the height of the deflector can vary from 0.75 to 4 times the diameter or the height of the outlet port provided in the rotating part.

Again according to the tests conducted, the deflector's inclination, with respect to the axis of the filament leaving the port present in the rotating plate, can vary between fifteen to sixty degrees or more.

It was also observed that the position of the deflector's upper edge, with respect to the outlet port of the rotating part, can occupy a position lower than the lowest point of the edge of the port, an intermediate position, or even above the highest point of the edge of the port.

The invention appears to utilize the Coanda effect or the wall effect which is well known in fluidics.

According to this effect, a fluid flux moving, or made to move in the vicinity of a wall, attempts to remain in contact therewith and only a considerable force, acting laterally, would be able to shift such a flux from the wall.

It seems that, according to this principle, the flux of the fluid emerging from the substantially radial port present in the rotating part of the spindle, and in particular the flux of the fluid issuing during the pneumatic threading phase, remains attached, or is made to adhere at the outset were it maintains such contact with the plate of the rotating part dragging therewith the filament.

Whatever effect it may be, it was observed that in certain cases, for instance when the filament is particulary suitable and the filament release by thereading on the part of the operator is done in a suitable way, whereby the outlet port is near or very near to the lower edge of the rotating plate and the curvature of the plate is appropriate, the filament remains substantially within the flux of the carrier fluid which filament is first dragged by the same out of the conduit, and then kept substantially in contact with the plate included in the rotating part and then directed upwardly together with the fluid itself.

It was noticed in these cases, that the presence of the deflector is almost useless, even if the operation becomes less favorable for it is necessarily much longer and thus costlier.

It was also noticed that the deflector can be temporarily positioned only during the threading phase.

Thus it is the flux created by both the filament and the rotating part which constantly keeps the deflector clean, in cooperation with the same, and carries the filament into the required position.

According to the invention the deflector is substantially provided in an intermediate area between the diameter at which the exit of the filament outlet port is arranged and the most extreme edge of the spindle's rotating plate.

The spindle dealt with here is provided with a balloon container, but in certain cases, this container may be omitted, and thus, for the purpose of this invention the presence of this container may be irrelevant.

In fact, leaving the deflector in position, even during the normal working phase of the spindle, the radial flux which develops particulary during this working phase of the spindle, in cooperation with the deflector, generates a support action for the balloon by releasing it at a position higher than usual.

Under certain conditions there is the problem of displacing the deflector during the spindle's normal working cycle.

Such displacement can be achieved radially, for instance, by dividing the deflector into sections, or axially, or otherwise by over-turning.

The invention is thus embodied by a deflector for twisting machine's spindles, advantageously but not necessary double twisting spindles with filament's pneumatic threading advantageously but not strictly with prepositioning of the rotating part of the spindle during the threading operation, wherein is provided at least temporarily one rimmed deflector substantially between the circumference described by the exit plane of the outlet port provided in the rotating part and the peripherical edge of the rotating part, the upper edge of the rimmed deflector being in cooperation with the neighborhood of the peripheral plane, in which lies the filament's outlet port made in the rotating part of the spindle, with the deflector cooperating by means of its own extension with that area in the neighborhood of the tangent to the curved rim of the rotating plate.

Other details and features of the invention will stand out from the description given below by way of non-limitative example and with reference to the accompanying drawings, in which;

FIG. 1 illustrates a vertical section of one type of a double twisting spindle;

FIGS. 2 to 7 showing various positions of the invention.

In the drawings a deflector is illustrated which encloses only one part of the circumference since it is presumed that the rotating part is prepositionable even if the means for executing said prepositioning are not illustrated and not illustrated and are considered irrelevant to the present invention.

It is implicit that the deflector may occupy any circumferential portion even circumferentially enclosing all of the rotating part.

With reference to the drawings, 10 is generically the spindle which may be of any vertical, horizontal or inclined type, such spindle also can be made and designed internally and externally in any suitable way.

In spindle 10, 11 generically indicates the stationary part of said spindle. In the spindle 10 the pulley 13 drives the rotating part 12 and the belt 113 drives pulley 13, the belt 113 can be replaced by any other known drive means which are irrevelant to the invention.

The bench on which the spindle 10 is supported or fixed is indicated as 14.

The rotating plate 15 is in the form of a cup integral to the rotating part 12, whose external rim or curved edge 115 can be of suitable shape in relation to the characteristics that must be imparted to the exit tangent 30.

From the part 16 of the plate, or the exit plane, emerges the conduit port 17 out of which comes the filament 29 during the double twisting phase.

The balloon container, indicated as 18 which, may be omitted in certain cases, is placed, even if not necessarily, at a higher position so that, the lower edge 19 thereof is advantageously above the upper edge 20 of the rotating plate 15 integral to the rotating part.

The deflector according to the invention is indicated as 21 and at least temporarily occupies an intermediate place between the exit plane 16 and the external part of the plate 15.

The deflector may circumferentially enclose the entire periphery of part 16, but may border only a small portion, substantially circumferential, in front of port 17 in the case where the rotating part 12 is prepositionable during the filament threading stage.

The deflector 21 extends vertically into a limited portion along the spindle.

Figure 4:
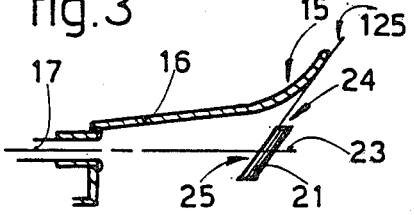
Figure 5:
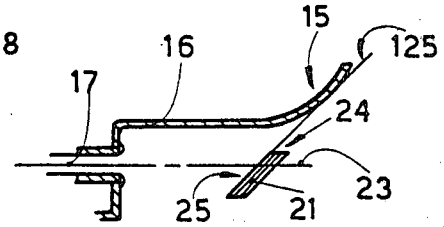
Figure 6:
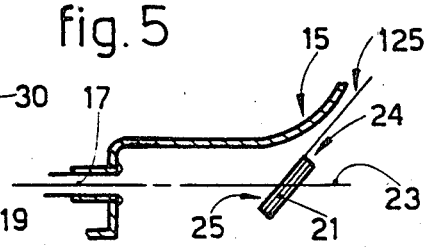
Figure 7:
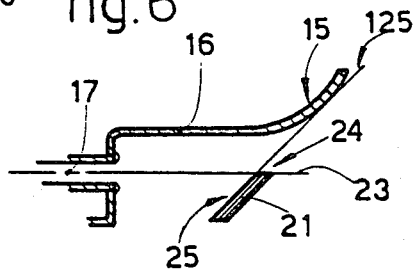

The deflector 21 may have the upper edge 24 of its rim at a level substantially coincident with the lower edge of the exit port 17 (see for example FIGS. 1, 2 and 7) or to a level coincident with the upper edge of said exit port 17 (see for example FIGS. 4, 6).

The centerline 23, of the filament exit from the rotating part 12 of spindle 10 can be directed at a predetermined angle.

The face 25 of the deflector's extension 125, cooperates with the tangent to the rim's curvature 115 of the plate 15 in the contact area.

Thus this face 25 may be predisposed in such a way that its tangent passes within the surface described by the rim's extension 125 of the rotating plate (FIGS. 2, 3) may coincides therewith (FIGS. 4, 5 and 7) or passes at a point falling beyond said rim as (FIG. 6).

As said before, the deflector 21, may have a depth that can vary between 0.75 to 4 times the height or the diameter of the port 17.

The inclination of face 25 with respect to the axis 23 can vary between fifteen to sixty degrees and more.

The deflector 21 can be fixed or mobile any may be complete, or in sections.

The deflector 21, is prearranged to be mobile, can move both axially and parallel to the spindle's axis or radially, by swinging or over-turning.

Schematically the deflector's support is indicated as 22 and that support 22 can be fixed or may allow the deflector 21 to perform such movement, as said earlier, i.e., it can be either linear, circular or a combination.

The exit centerline of port 17, or rather the hypothetical line along which emerge both the carrier gas and the filament from the port 17, is shown as 23 while the extension thereof towards the curved edge 115 of plate 15 is indicated as 125.

The junction area 26 or rim is arranged between the plate 15 and the portion 16.

The injection system, even of the venturi type, is indicated as 27 and it serves for threading the filament, such injection means can occupy any part of the spindle since they are illustrated here for completeness only.

The spool of the reel which unwinds the filament 29 to be doubled is indicated as 28, such spools may be provided in pairs or more, so as to double two filaments or more.

The departure tangent of the plate 15 of the tangent at which the filament leaves the curved rim 115 in the area substantially adjacent to the upper edge 20 is indicated as 30.

According to the invention, the port 17 may be positioned on wall 16 and may even by very near to the junction rim 26 so that the gaseous fluid emerging from such conduit 17 exits in the immediate vicinity of the external wall of the plate 15 on which it tends to slide.

It is advantageous that the lower edge 19 of the balloon container 18 is extended to at least below the contact area between the departure tangent 30 and the balloon container 18 itself.

The invention is described hereabove but other embodiments are possible.

It is thus possible to vary proportions and dimensions, add or modify parts; envisage any suitable means of lubricating or oiling the filament; it is possible to omit the balloon container, and so on.

These and other embodiments being all obtainable by a person skilled in the art.

We claim:

1. In a twisting machine spindle comprising a pneumatic filament threader and a rotating device containing a substantially horizontal outlet port for said filament and fluid and defining an outer wall and a rotating plate having a curved rim the improvement comprising a filament and fluid deflector positioned between a circumference described by the outer wall and a periphery of the rotating plate, said deflector being in a radial plane defined by the outlet port of the filament and defining an extension of a contact face thereof directed toward the curved rim of the rotating plate.

2. In the spindle of claim 1 wherein the deflector has an upper edge positioned at a height corresponding to a lower edge of the outlet port.

3. In the spindle of claim 1 wherein the deflector has an upper edge positioned at a height corresponding to an intermediate position with respect to the outlet port.

4. In the spindle of claim 1 wherein the deflector has an upper edge positioned at a height corresponding to an upper edge of the outlet port.

5. In the spindle of one of claims 1–4 wherein said extension of said deflector intersects the rim of the rotating plate.

6. In the spindle of one of claims 1–4 wherein said extension of said deflector is tangent to the rim of the rotating plate.

7. In the spindle of one of claims 1–4 wherein said extension of said deflector does not contact the rim of the rotating plate.

8. In the spindle of one of claims 1–4 wherein the deflector is fixed with respect to the spindle.

9. In the spindle of one of claims 1–4 wherein the deflector is removable.

10. In the spindle of one of claims 1–4 wherein the deflector only partially surrounds the rotating part.

11. In the spindle of one of claims 1–4 wherein the deflector surrounds the rotating part.

* * * * *